US009149917B2

(12) United States Patent
Beer et al.

(10) Patent No.: US 9,149,917 B2
(45) Date of Patent: Oct. 6, 2015

(54) HAND TOOL HEAD ASSEMBLY AND HOUSING APPARATUS

(71) Applicant: Snap-on Incorporated, Kenosha, WI (US)

(72) Inventors: Joshua M Beer, Racine, WI (US); Kenneth C Happ, Burlington, WI (US)

(73) Assignee: Snap-on Incorporated, Kenosha, WI (US)

( * ) Notice: Subject to any disclaimer, the term of this patent is extended or adjusted under 35 U.S.C. 154(b) by 201 days.

(21) Appl. No.: 13/894,805

(22) Filed: May 15, 2013

(65) Prior Publication Data

US 2014/0338503 A1 Nov. 20, 2014

(51) Int. Cl.
*B25B 21/00* (2006.01)
*B25B 23/00* (2006.01)

(52) U.S. Cl.
CPC ..... *B25B 21/004* (2013.01); *B25B 23/0007* (2013.01); *Y10T 29/49947* (2015.01)

(58) Field of Classification Search
CPC ..... B25B 21/004; B25B 23/0007
USPC ..... 81/57.39
See application file for complete search history.

(56) References Cited

U.S. PATENT DOCUMENTS 6,915,721 B2 * 7/2005 Hsu et al. ..... 81/57.13
7,735,398 B2 * 6/2010 Hsu et al. ..... 81/57.39
2007/0251711 A1 * 11/2007 Chen ..... 173/213
2008/0190246 A1 8/2008 Hsu et al.
2011/0265958 A1 * 11/2011 Skinner et al. ..... 160/127
2012/0090863 A1 * 4/2012 Puzio et al. ..... 173/2
2012/0186400 A1 7/2012 Elger
2013/0075121 A1 * 3/2013 Nakamura ..... B25B 21/02 173/194
2014/0157961 A1 * 6/2014 Chen ..... 81/464

FOREIGN PATENT DOCUMENTS

EP 1132176 A1 9/2001
EP 1132179 A1 9/2001
GB 2124112 A 2/1984
JP WO 2011111850 A1 * 9/2011 ..... B25B 21/02

OTHER PUBLICATIONS

Combined Search and Examination Report for GB 1407720.0, dated Sep. 4, 2014.
State Intellectual Property Office of P.R., The First Office Action, dated Aug. 5, 2015; with English Translations; 10 pages, Application No. 201410205051.8—Hand Tool Head Assembly and Housing Apparatus.

* cited by examiner

*Primary Examiner* — David B Thomas
(74) *Attorney, Agent, or Firm* — Seyfarth Shaw LLP

(57) ABSTRACT

A hand tool, such as a motorized cordless ratchet wrench, is configured for reducing part count and reducing assembly processes. The hand tool includes a clamshell housing that may be fastened to a drive member such as a ratchet head assembly without the use of additional fasteners such as large clamp nuts or additional screw sets, for example. One or more protrusions extending inwardly from the clamshell housing engage similarly shaped voids in the ratchet head assembly. The protrusions tightly engage the ratchet head housing when the clamshell housing portions are fastened together.

11 Claims, 6 Drawing Sheets

HAND TOOL HEAD ASSEMBLY AND HOUSING APPARATUS

TECHNICAL FIELD OF THE INVENTION

The present invention relates to a motorized hand tool for applying torque to a work piece. More particularly, the present invention relates to a clamshell housing coupling to a head assembly of a motorized hand tool.

BACKGROUND OF THE INVENTION

Power hand tools, such as motorized ratchet wrenches and drivers, are commonly used in automotive, industrial and household applications to install and remove threaded fasteners and to apply a torque and/or angular displacement to a work piece such as a threaded fastener, for example. Motorized hand tools, such as cordless power ratchets and drivers, generally include an electric motor contained in a clamshell housing along with other components such as switches, light emitting diodes (LEDs), and batteries, for example. The clamshell housing generally includes two or more housing portions fastened together by fasteners, such as screws or rivets.

The process of assembling a clamshell housing to a drive member, such as a ratchet head housing in a motorized hand tool, generally involves one or more large clamp nuts or a set of screws in addition to fasteners used to couple portions of the clamshell housing together, for example. The additional large clamp nuts and/or screws may create an unsightly appearance and may add bulk to portions of the tool, thereby impeding proper use of the tool in small spaces. The large clamp nuts may also loosen over time and allow the ratchet head to become loose from the clamshell housing.

SUMMARY OF THE INVENTION

According to embodiments of the present invention, a motorized hand tool, such as a cordless ratchet wrench, includes a clamshell housing that may be fastened to a drive member such as a ratchet head assembly without the use of additional fasteners such as large clamp nuts or additional screw sets, for example. One or more protrusions extending inwardly from the clamshell housing engage similarly shaped voids in the ratchet head assembly. The protrusions may include a radial flange, a T-shaped protrusion and/or one or more screw bosses. The protrusions tightly engage the ratchet head housing when the clamshell housing portions are fastened together. The rigid connection created between the clamshell housing and the ratchet head housing absorbs torque and helps prevent the tool from breaking apart when subject to drops or other impacts.

According to aspects of the present invention, the cost of a motorized hand tool may be reduced by reduction of parts count and eliminating the manufacturing steps involved with installing clamp nuts or screws dedicated to fastening the ratchet head assembly to the clamshell housing. The disclosed hand tool is aesthetically improved and has fewer external fasteners that could loosen and/or interfere with comfortable use of the tool.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

Figure 1A:
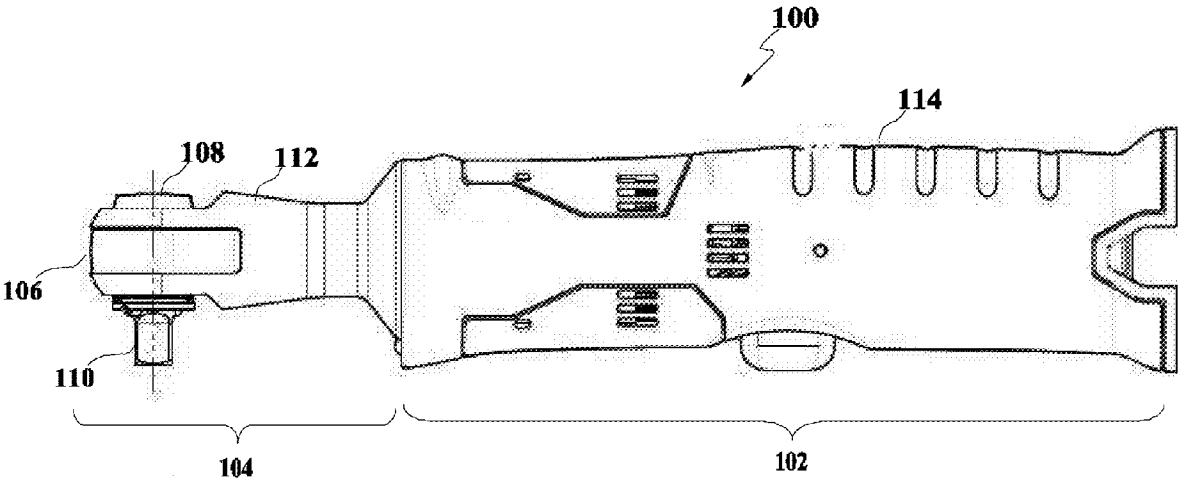
FIG. 1A is a side view drawing illustrating an exemplar tool, such as a cordless ratchet tool including a ratchet head assembly coupled to a motor assembly, in accordance with an embodiment of the present invention.

It should be understood that the comments included in the notes as well as the materials, dimensions and tolerances discussed therein are simply proposals such that one skilled in the art would be able to modify the proposals within the scope of the present invention.

DETAILED DESCRIPTION OF THE EMBODIMENTS

While this invention is susceptible of embodiments in many different forms, there is shown in the drawings, and will herein be described in detail, a preferred embodiment of the invention with the understanding that the present invention is to be considered as an exemplification of the principles of the invention and is not intended to limit the broad aspect of the invention to embodiments illustrated.

Figure 1B:
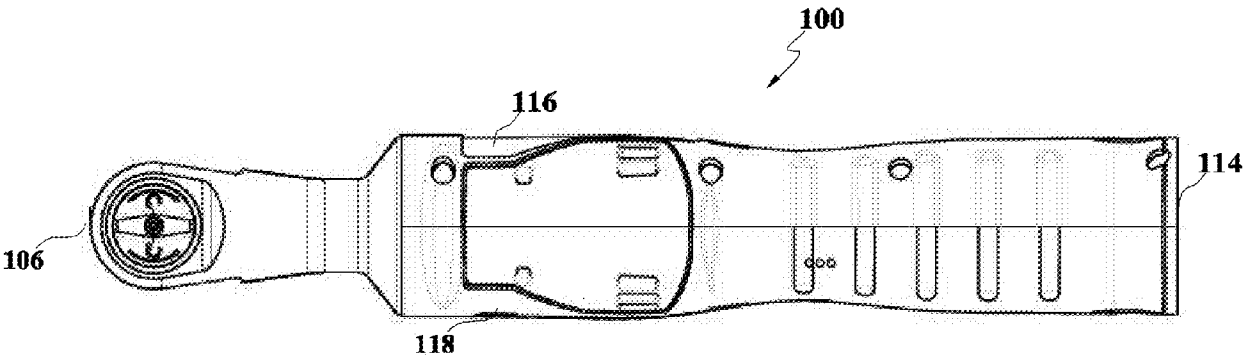
FIG. 1B is a top view drawing illustrating an exemplar tool, such as a cordless ratchet tool including a ratchet head assembly coupled to a motor assembly, in accordance with an embodiment of the present invention.

Embodiments of the present invention may be implemented in a hand tool, such as the cordless ratchet tool shown in FIG. 1A. The cordless ratchet tool 100 includes a handle portion 102 coupled to a driver portion 104. The driver portion 104 may include a ratchet head assembly 106 including a ratchet housing 112, ratchet head 110, and selector knob 108, for example. The handle portion 102 may include a main housing 114 enclosing an electric motor, a switch assembly and one or more status indicators such as light emitting diodes (LED), for example. FIG. 1B shows a top view of the cordless ratchet tool 100. Referring to FIG. 1B, the main housing 114 may be assembled from two or more clamshell housing portions 116, 118 fastened together and securely attached to the ratchet head assembly 106.

Figure 2:
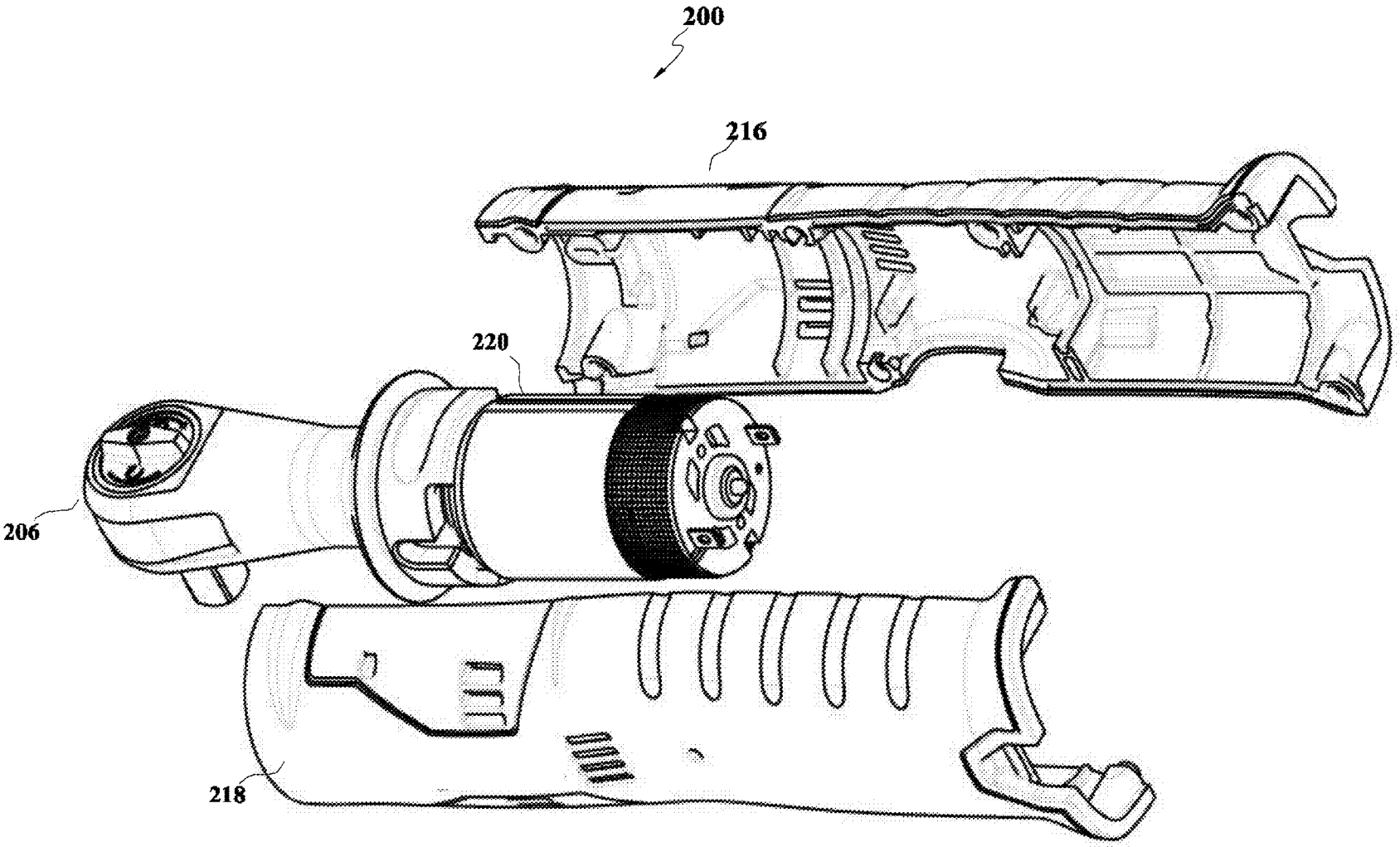
FIG. 2 is an exploded view drawing of an exemplar tool having a ratchet head, motor and clamshell housing assembly of a cordless ratchet tool, in accordance with an embodiment of the present invention.

FIG. 2 shows a ratchet head assembly 206 of a cordless ratchet tool assembly 200 coupled to a motor assembly 220 according to an aspect of the present invention. A first clamshell housing portion 216 and second clamshell housing portion 218 of the cordless ratchet tool assembly 200 are configured for assembly around the motor assembly 220.

Figure 3:
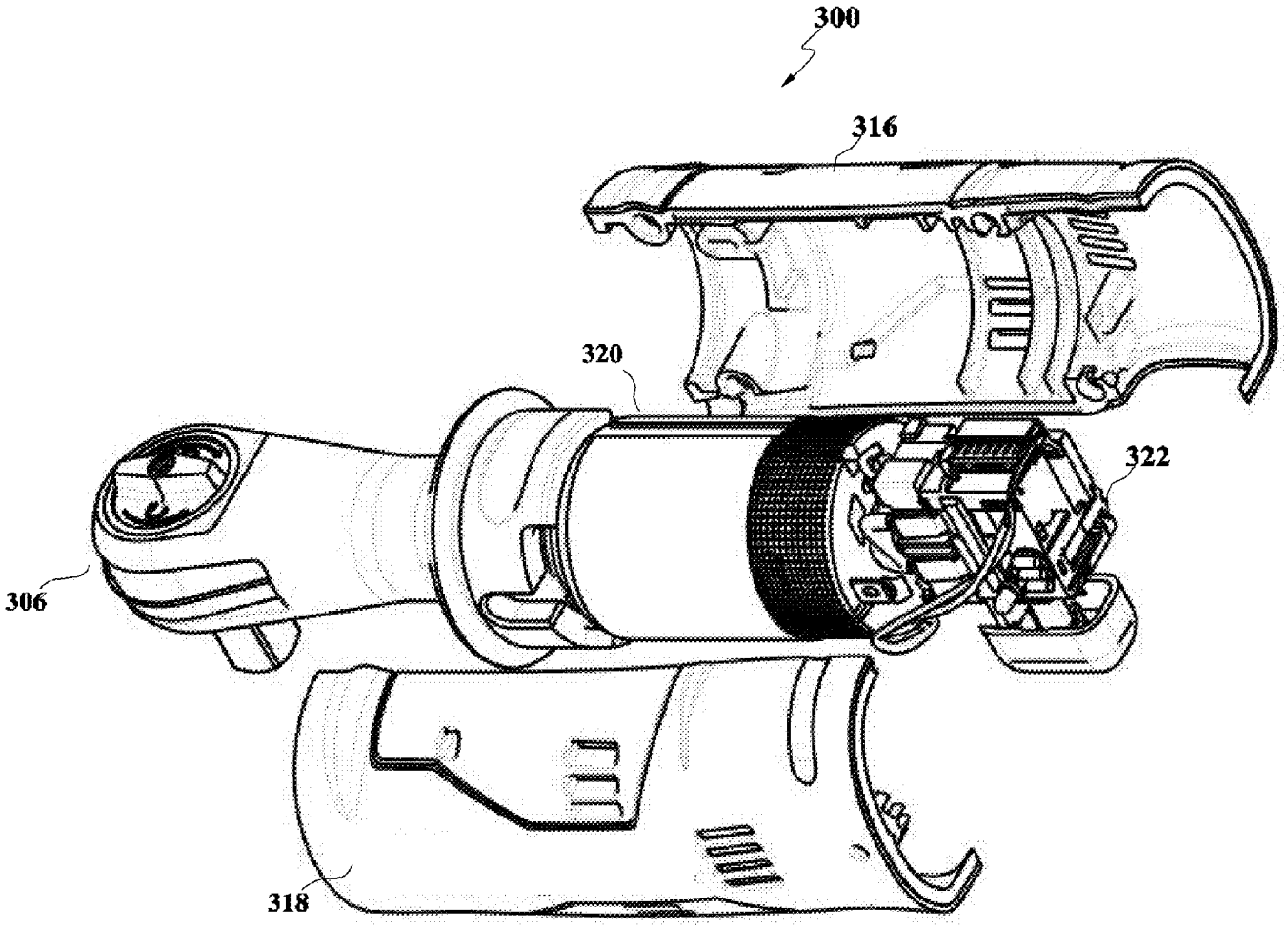
FIG. 3 is an exploded view drawing of an exemplar too having a ratchet head, motor, switch and clamshell housing assembly of a cordless ratchet tool, in accordance with an embodiment of the present invention.

FIG. 3 shows a ratchet head assembly 306 of a cordless ratchet tool assembly 300 coupled to a motor assembly 320 and a switch assembly 322 according to another aspect of the present invention. A first clamshell housing portion 316 and second clamshell housing portion 318 of the cordless ratchet tool assembly 300 are configured for assembly around the motor assembly 320.

A ratchet head and motor subassembly 400 according to an aspect of the present invention is described with reference to FIGS. 4A-4D. The ratchet head and motor subassembly 400 shown in FIG. 4A includes a motor assembly 420 coupled to a ratchet head assembly 406. The motor assembly 420 includes an electric motor 420 coupled to a motor end plate such as the motor end plate 424 shown in FIG. 4D.

The motor end plate 426 may be fastened to the electric motor 424 by fasteners such as rivets or screws through fastener holes 430, for example. According to an aspect of the present invention, the motor end plate 426 includes one or more outwardly protruding semi-annular flanges 428. The flanges 428 are configured to fit in a semi-annular slot 432 formed by an undercut behind a lip 434 around a periphery in the ratchet head housing 412. One or more discontinuities in the lip 434 create one or more apertures 436 that are sized to cooperatively receive each of the one or more flanges 428 of the motor end plate 426 during assembly of the motor end plate 426 to the ratchet head housing 412 and during disassembly of the motor end plate 426 from the ratchet head housing 412. The motor end plate 426 may also include one or more detent structures (not shown) configured to provide tactile indications of proper rotation displacement during assembly.

According to aspects of the present invention, the motor assembly 420 is coupled to the ratchet head housing 412 by pushing the flanges 428 of the motor end plate 426 through the apertures 436 in the lip 434 of the ratchet head housing 412 then rotating the motor assembly 420 relative to the ratchet head housing 412 until the flanges 428 of the motor end plate 426 are secured in the semi-annular slot 432 of the ratchet head housing 412. In one example, the flanges 428 and apertures 436 are sized so that the motor assembly 420 may be rotated 90 degrees in either direction to engage the semi-annular slots 432 of the ratchet head housing 412 during an assembly process or to disengage the semi-annular slots 432 of the ratchet head housing during a disassembly process. A compressible member such a steel wave washer or an O-ring (not shown) made from a compressible material such as rubber or other elastomer, for example, may be installed between the motor assembly 420 and the ratchet head housing 412 to absorb dimensional tolerances. The compressible member is compressed during assembly of the motor assembly 420 to the ratchet head housing 412 and provides pressure between the flange 428 and lip 434 that facilitates a tight fit and alignment of drive gears, for example.

Figure 5:
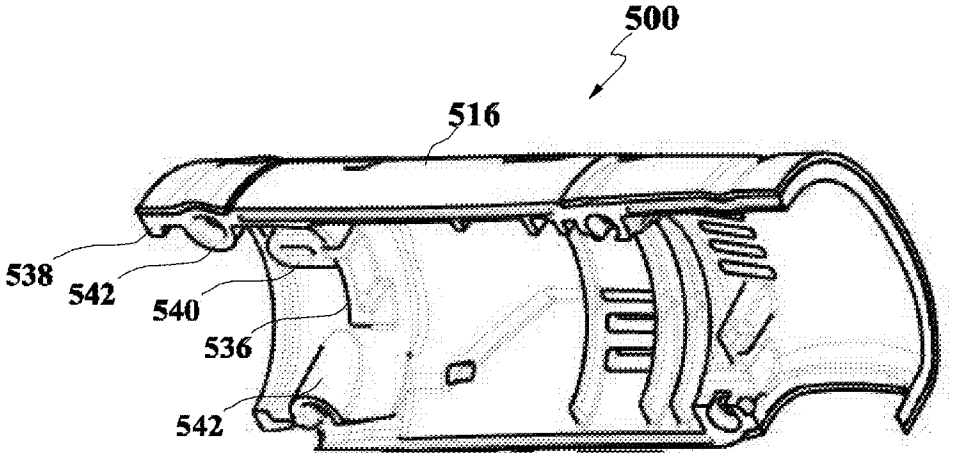
FIG. 5 is an illustration of a clamshell housing portion in accordance with an embodiment of the present invention.

In an embodiment of the present invention, a rib protruding inwardly from one or more clamshell housing portions is shaped to substantially fill the one or more apertures 436 when the clam shell housing is assembled to the ratchet head and motor subassembly 400. Referring to FIG. 5, one or more semi-annular ribs 536 in a first clamshell housing portion 516 are shaped to fit into and substantially fill the one or more apertures 436, for example. The semi-annular ribs 536 prevent the motor end plate 426 from rotating out of the slot 432 in the ratchet head housing 412.

Figure 4A:
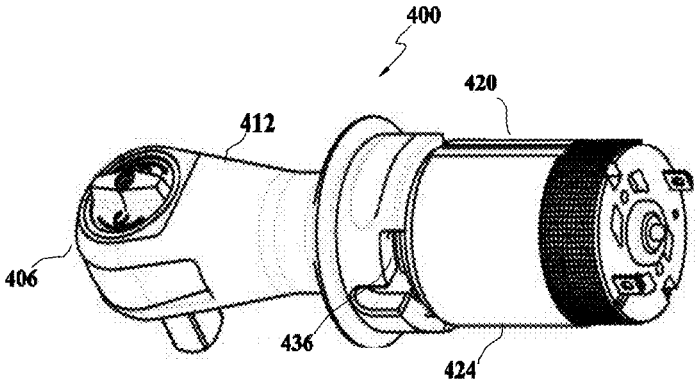
FIG. 4A is an illustration of an exemplar too having a ratchet head and motor subassembly in accordance with an embodiment of the present invention.
Figure 4B:
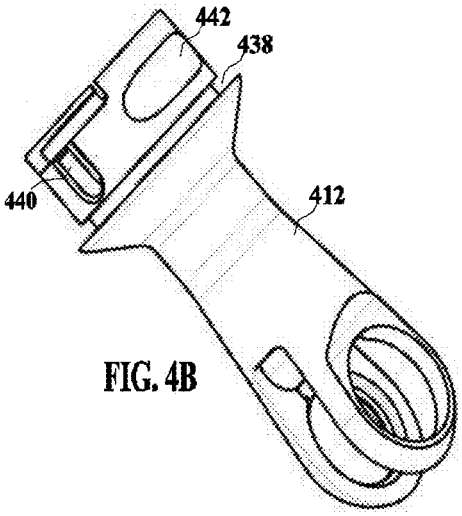
FIG. 4B is an illustration of a ratchet head housing of a cordless ratchet tool in accordance with an embodiment of the present invention.
Figure 4C:
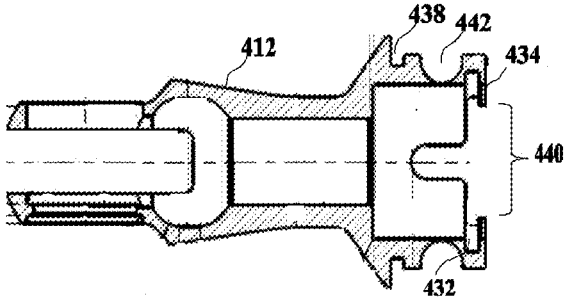
FIG. 4C is a cross sectional view of a ratchet head housing of a cordless ratchet tool in accordance with an embodiment of the present invention.
Figure 4D:
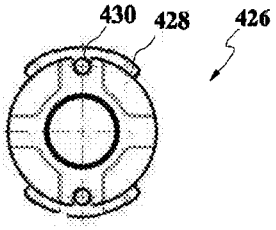
FIG. 4D is an illustration of a motor end plate of a cordless ratchet tool in accordance with an embodiment of the present invention.

According to another embodiment of the present invention, one or more clamshell housing portions include one or more protrusions extending inwardly from the clamshell housing. The one or more protrusions tightly engage similarly shaped voids in the ratchet head assembly. Referring to FIG. 5, the protrusions may include a radial flange 538, a T-shaped protrusion 540 and/or one or more screw bosses 542. The protrusions tightly engage the ratchet head housing when the clamshell housing portions are fastened together. Referring to FIGS. 4A-4C, the ratchet head housing 412 may include a radial flange slot 438, a T-shaped aperture 440 and/or one or more concave channels 442 arranged to tightly receive the radial flange 538, the T-shaped protrusion 540 and/or the one or more screw bosses 542, respectively.

Referring to FIG. 2, a first clamshell housing portion 216 may be fastened to a second clamshell housing portion 218 around the ratchet head assembly 206 using fasteners such as screws or rivets, for example. When assembled, as shown in FIGS. 1A and 1B, for example, the inward protrusions on the clamshell housing prevent the ratchet head assembly from rotating or moving axially relative to the clamshell housing. The cordless ratchet tool 100 shown in FIGS. 1A and 1B may include the radial flange 538, a T-shaped protrusion 540 and/or one or more screw bosses 542 engaged with the radial flange slot 438. T-shaped aperture 440 and/or one or more concave channels 442 described above are intended to reduce parts count and eliminate the manufacturing steps that would otherwise be needed to installing clamp nuts or screws dedicated to fastening the ratchet head assembly to the clamshell housing. The disclosed cordless ratchet tool 100 may be constructed without externally projecting clamp nuts or screws that could loosen and/or interfere with comfortable use of the tool.

Figure 6:
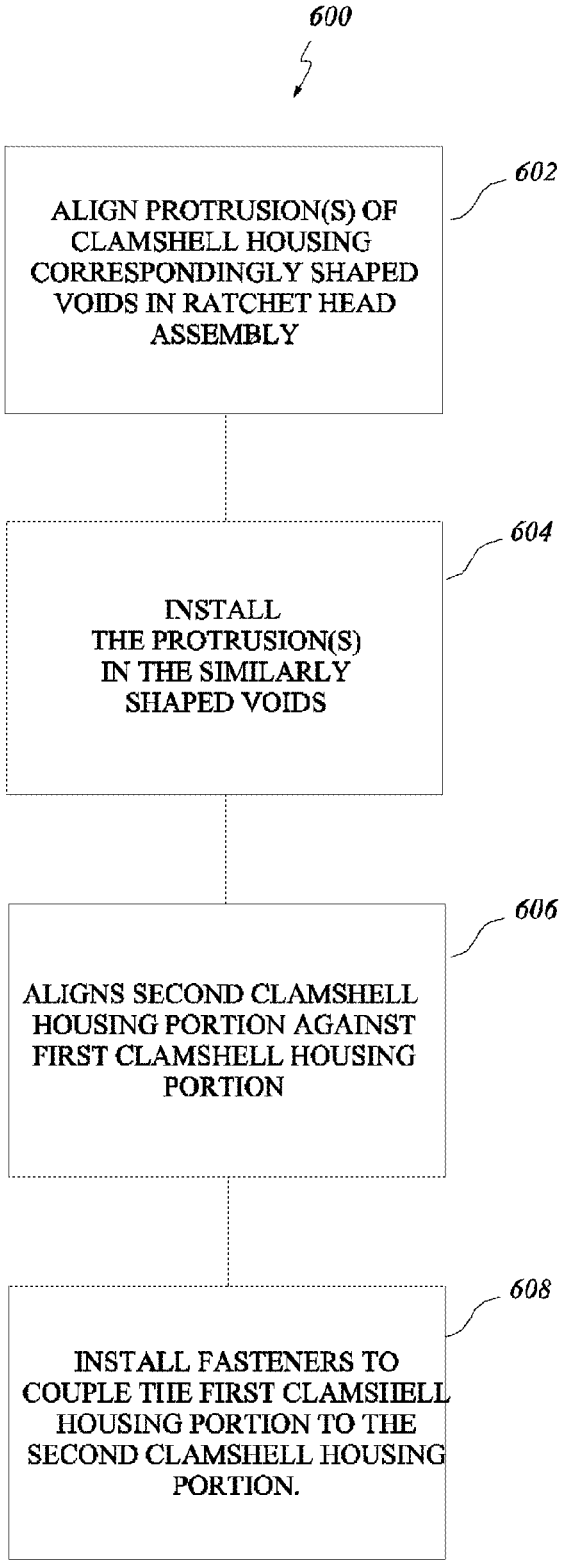
FIG. 6 is a process flow diagram illustrating a method of assembling a cordless ratchet tool in accordance with an embodiment of the present invention.

FIG. 6 is a process flow diagram illustrating a process 600 for assembling a hand tool according to an aspect of the present invention. As shown, the process 600 begins and proceeds to step 602, which includes aligning one or more protrusions of a first clamshell housing portion with one or more similarly shaped voids in a ratchet head assembly. In step 604, the process includes installing the one or more protrusions in the one or more similarly shaped voids. In step 606, the process includes aligning a second clamshell housing portion against the first clamshell housing portion. In step 608, the process includes installing fasteners to couple the first clamshell housing portion to the second clamshell housing portion. According to aspects of the present invention, the one or more protrusions may include a radial flange, a T-shaped protrusion and/or a screw boss extending inward from the first clamshell housing portion, for example.

As discussed above, the aspects of the present invention are described in terms of a cordless ratchet tool 100. as shown in FIG. 1. However, it should be understood that aspects of the present invention could be implanted in other hand tools or implements. For example, and without limitation, the hand tool can be ratchet wrench, open wrench, screw driver, nut driver, or any other tool capable of applying torque to a work piece.

As used herein, the term "coupled" or "communicably coupled" can mean any physical, electrical, magnetic, or other connection, either direct or indirect, between two parties. The term "coupled" is not limited to a fixed direct coupling between two entities.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

What is claimed is:

1. A hand tool comprising:

a motor assembly;

a head assembly coupled to the motor assembly and including a head housing having a shaped aperture and a concave channel formed in an exterior of the head housing; and a clamshell housing having first and second housing portions adapted to be coupled to one another and defining a clamshell housing cavity that houses the head assembly, wherein the clam shell housing includes a shaped protrusion and a screw boss extending inwardly, the shaped protrusion cooperatively engaging the shaped aperture and the screw boss cooperatively engaging the concave channel, thereby preventing rotational and axial movement of the head housing relative to the clamshell housing.

2. The hand tool of claim 1, wherein the clamshell housing further includes a radial flange.

3. The hand tool of claim 1, wherein the shaped protrusion is T-shaped.

4. The hand tool of claim 1, wherein the head housing includes a radial slot configured to cooperatively engage a radial flange disposed on the clamshell housing.

5. The hand tool of claim 1, wherein the shaped aperture is T-shaped and the shaper protrusion is T-shaped.

6. The hand tool of claim 1, further comprising a fastener threadingly engaged with the screw boss to couple the first and second clamshell housing portions to one another.

7. The hand tool of claim 1, wherein the motor assembly is disposed within the clamshell housing cavity and includes an electric motor operably coupled to a motor end plate.

8. A method of assembling a hand tool, comprising:

aligning a shaped protrusion disposed on a first clamshell housing portion with a correspondingly shaped aperture disposed on a head assembly;

aligning a screw boss disposed on the first clamshell housing portion with a concave channel disposed on the head assembly;

inserting the shaped protrusion in the shaped aperture;

inserting the screw boss in the concave channel;

aligning a second clamshell housing portion with the first clamshell housing portion; and coupling the first and second clamshell housing portions to one another, thereby defining a clamshell housing cavity.

9. The method of claim 8, wherein the shaped protrusion is T-shaped and extends inwardly from the first clamshell housing portion.

10. The method of claim 8, further comprising coupling a motor assembly to the head assembly and disposing the motor assembly within the clamshell housing cavity.

11. A motorized cordless ratchet wrench, comprising:

a motor assembly;

a ratchet head assembly operably coupled to the motor assembly and including a shaped aperture extending at least partially through a peripheral wall of a ratchet head housing and a concave channel extending at least partially into the ratchet head housing;

a steel wave washer disposed between the motor assembly and the ratchet head assembly; and a clamshell housing defining a cavity that houses the motor assembly and the ratchet head assembly, the clamshell housing including a T-shaped protrusion extending inwardly to cooperatively engage the shaped aperture and a screw boss extending inwardly to cooperatively engage the concave channel, thereby preventing rotational and axial movement of the ratchet head housing relative to the clamshell housing.

* * * * *